US006076746A

United States Patent [19]

Kantor et al.

[11] Patent Number: 6,076,746

[45] Date of Patent: Jun. 20, 2000

[54] STRIP IRRIGATOR

[75] Inventors: Issak Kantor, Rosh Pina; Yoel Zur, Korazim; Jonathan Bar-Or, Jordan Valley, all of Israel

[73] Assignee: Dan Mamtirim, Haelion, Israel

[21] Appl. No.: 09/140,237

[22] Filed: Aug. 26, 1998

[30] Foreign Application Priority Data

Sep. 9, 1997 [IL] Israel ..... 121726

[51] Int. Cl.[7] ..... B05B 3/04

[52] U.S. Cl. ..... 239/222.17; 239/222.11; 239/232; 239/251; 239/255; 239/499

[58] Field of Search ..... 239/231, 232, 239/251, 253, 255, 222.11, 222.17, 499

[56] References Cited

U.S. PATENT DOCUMENTS

| | | | |
|---|---|---|---|
| 961,006 | 6/1910 | Perry | 239/222.17 |
| 1,778,994 | 10/1930 | Allen . | |
| 2,021,710 | 11/1935 | Wilson | 239/231 |
| 3,658,252 | 4/1972 | Costa | 239/231 X |
| 4,611,760 | 9/1986 | Koresh . | |
| 4,805,838 | 2/1989 | Greenberg | 239/222.17 |
| 5,588,595 | 12/1996 | Sweet et al. | 239/222.17 |
| 5,671,885 | 9/1997 | Davisson | 239/222.17 |

FOREIGN PATENT DOCUMENTS

| | | | |
|---|---|---|---|
| 855622 | 2/1988 | Israel . | |
| 1047442 | 10/1983 | U.S.S.R. | 239/251 |
| 587166 | 4/1947 | United Kingdom | 239/232 |

*Primary Examiner*—Steven O. Douglas
*Assistant Examiner*—Kathleen J. Prunner
*Attorney, Agent, or Firm*—Greer, Burns & Crain, Ltd.

[57] ABSTRACT

A Strip irrigator comprising a body member fitted with an inlet for coupling to an irrigation water supply and an outlet nozzle of said body member, defining a longitudinal axis, a distribution member formed with a water engaging portion consisting of two ducts forming between them an essentially V-like shape with an intersection adjacent a lower end thereof, each duct ending at a deflection groove, and a support bracket pivotally supporting the distribution member to the body member. The arrangement being such that responsive to a water jet emitted from the outlet nozzle, the distribution member generates reactionary forces imparting it as a reciprocal rocking motion about a horizontal axis perpendicular to the longitudinal axis.

18 Claims, 14 Drawing Sheets

FIG.4
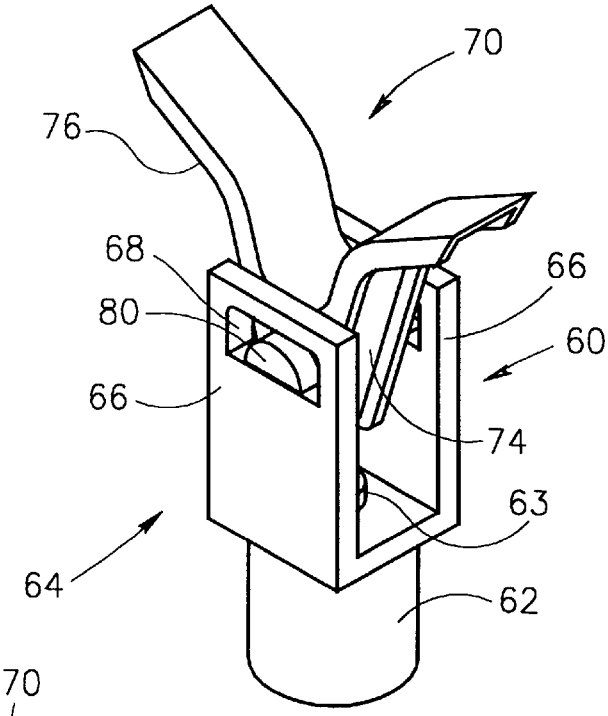
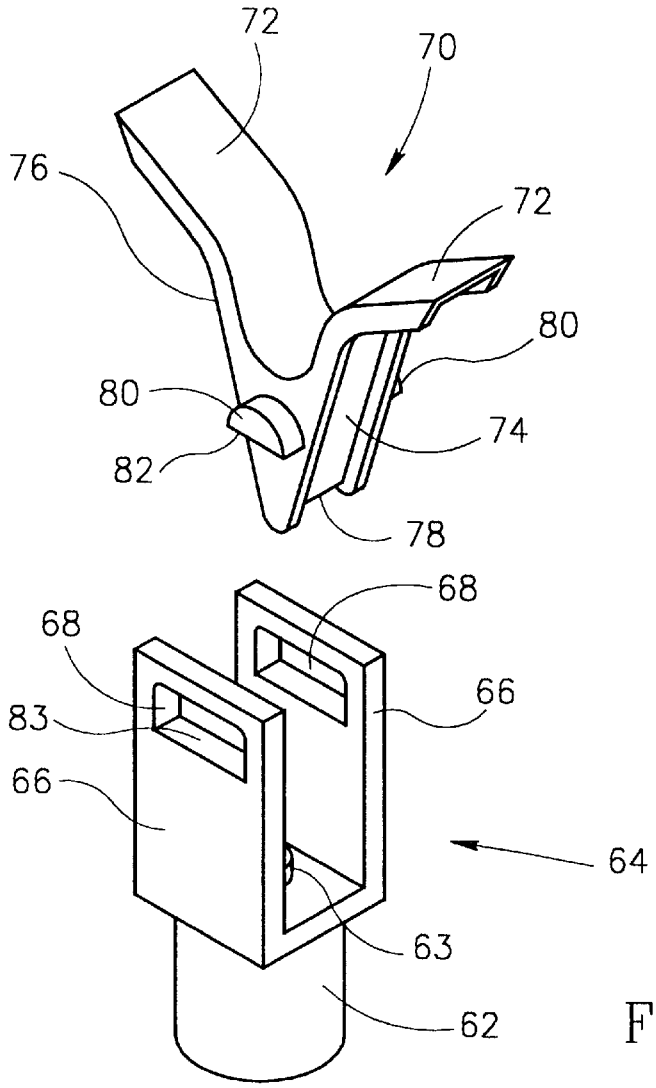
FIG.5

STRIP IRRIGATOR

FIELD OF THE INVENTION

The present invention is in the field of sprinklers and more specifically it is concerned with a sprinkler suitable for irrigating a strip-like pattern.

BACKGROUND OF THE INVENTION AND PRIOR ART

In the following description and claims the term "strip irrigator" refers to a sprinkler suitable for irrigating essentially rectangular narrow patterns. The terms irrigator and sprinkler are used interchangeably hereinafter in the specification and claims.

Strip irrigators are useful for irrigating strip-shaped gardens and fields, so as to avoid wetting of pedestrian pathways etc. on the one hand and, on the other hand, to enable irrigation at precise patterns, thus avoiding overlapping areas between adjacent sprinklers adapted for irrigating circular patterns, where considerable amounts of water are wasted, and which excessive irrigation water may at times also be harmful. It is for these reasons that strip irrigators are often used also for protection against frost, as known, per se.

U.S. Pat. No. 1,778,994 discloses a lawn spray control device comprising a body fitted with twin outlet nozzles and a pair of spray deflecting wings, each associated with an outlet nozzle and being pivotally secured at opposite ends to the body member. The deflecting wings are swingable between a closed position effective in causing a spray emitted from the nozzle to cover relatively narrow areas of a lawn or ground immediately adjacent to, and in longitudinal alignment with the body of the device; and an open position of the wings in which the spray will be directed over a considerable area. The device in accordance with the '994 patent allows for manipulation of either or both of the deflecting wings, whereby a different range of irrigation may be obtained at each side of the device.

The arrangement according to the '994 patent is such that the irrigation water supply is directed in two opposite directions, whereby the irrigation distance is significantly reduced. Furthermore, the water jets striking each of the deflector walls is separated into fine showers which will further decrease the irrigation range of the sprinkler.

It is an object of the present invention to provide a new and improved sprinkler suitable for irrigating essentially rectangular patterns and in which the above referred to disadvantages are substantially reduced or overcome.

BRIEF SUMMARY OF THE INVENTION

According to the present invention, there is provided a strip irrigator comprising:

- a body member fitted with an inlet for coupling to an irrigation water supply and an outlet nozzle of said body member, said outlet defining a longitudinal axis;
- a distribution member formed with a water engaging portion consisting of two ducts forming between them an essentially V-like shape with an intersection adjacent a lower end thereof, each duct ending at a deflection groove;
- a support bracket pivotally supporting the distribution member to said body member;
- wherein responsive to a water jet emitted from said outlet nozzle the distribution member generates reactionary forces imparting it a reciprocal rocking motion about a horizontal axis perpendicular to the longitudinal axis.

According to a first embodiment of the invention the deflection grooves extend from the intersection, and where said deflection grooves face away from one another. The arrangement in accordance with such an embodiment is that said reactionary forces impart the distribution member with a combined motion consisting of the reciprocal rocking motion and an auxiliary reciprocal motion consisting of at least one motion selected from a first motion being a sliding motion along a horizontal plane normal to said longitudinal axis and a second motion being a swinging motion about a second horizontal axis perpendicular to said longitudinal axis.

By one specific embodiment of the invention, the support bracket is integral with the distribution member. By another embodiment, said support bracket is integral with the body member and wherein the distribution member is horizontally slidable with respect to the support bracket, thus constituting said first motion.

According to a second embodiment of the present invention, said support bracket is reciprocally swingable with respect to the housing about a horizontal axis parallel to said first horizontal axis, thus constituting said second motion.

Preferably, the support bracket is a bifurcated bracket adapted for receiving the distribution member. Still preferably, the support bracket is formed with boundary elements for restricting the rocking motion. In the embodiment where the auxiliary motion is said second motion, then the support bracket is formed with the boundary elements. By another application of the invention, the body member is fitted with the boundary elements.

Alternatively, the deflection grooves intersect along an essentially straight line forming a blade-like apex. Still preferably, an upper, discharge end of each of the deflection grooves of the distribution member is narrower than the lowermost end thereof.

According to the first embodiment of the present invention either the support bracket or the distribution member is formed with a horizontal recess and the other of either the support bracket or the distribution member is formed with a lateral projection slidably retained within said recess.

In accordance with the second embodiment of the present invention, either the support bracket or the distribution member comprises a receiving opening at each side thereof and the other of either support bracket or the distribution member is formed with a laterally projecting, horizontal pin at each side thereof, which pins are swingably received within said openings.

By a preferred application of the invention, the irrigator is a strip irrigator wherein the irrigation pattern is essentially a rectangle extending at each side of the sprinkler and being about 4–5 m long and about 0.5 m wide.

According to one specific application of the invention, an upper, discharge end of each of the deflection grooves of the distribution member is narrower than the duct.

According to still another embodiment of the invention, the deflection grooves face each other. In accordance with one option, water is emitted from a deflection groove in the same direction as of the duct which engages the water. Alternatively, water is emitted from a deflection groove in a direction opposite to that of the duct which engages the water.

The arrangement of the present invention is such that essentially all irrigation water emitted from the outlet nozzle is directed at either one of the deflection grooves apart from a singular point at which the intersecting apex is above said outlet nozzle.

BRIEF DESCRIPTION OF THE DRAWINGS

For better understanding, the invention will now be described by way of example only, with reference to the accompanying drawings, in which:

FIG. 4 is a perspective view of a second application of the first embodiment of a sprinkler in accordance with the present invention;

FIG. 5 is a perspective exploded view of the embodiment of FIG. 4;

FIG. 14A and 14B are views of another embodiment of a sprinkler in accordance with the present invention, wherein:

FIG. 14A is a complete isometric view;

FIG. 14B is an isometric view with a front wall and a front bracket removed;

DETAILED DESCRIPTION OF THE SPECIFIC EMBODIMENTS

Figure 1:
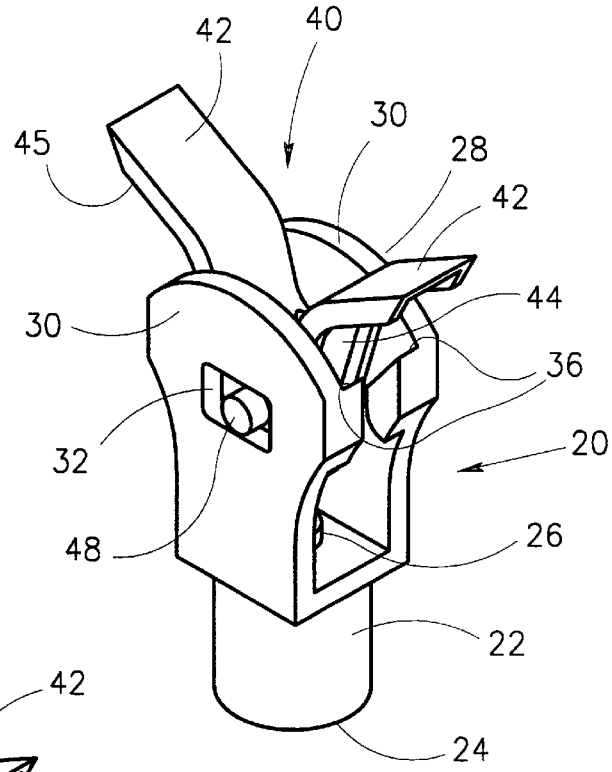
FIG. 1 is a perspective view of an application in accordance with the first embodiment of the present invention.
Figure 2:
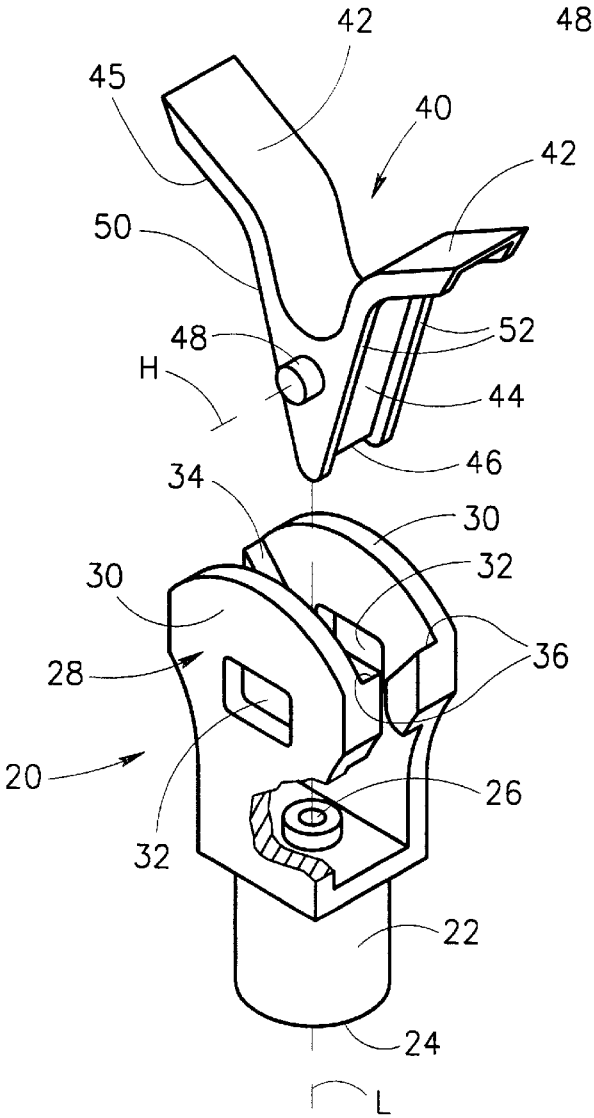
FIG. 2 is a perspective exploded view of the embodiment of FIG. 1.

Attention is first directed to FIGS. 1 and 2 of the drawings, in which a sprinkler generally designated 20 comprises a body member 22 fitted with an inlet 24 and an outlet 26, defining between them a longitudinal axis L.

A bifurcated support bracket 28 is integral with the body member 22 and extends upwardly from the outlet nozzle 26. The bracket 28 comprises two support walls 30 each formed adjacent a top end thereof with a horizontally extending rectangular opening 32 and two boundaries 34 and 36 (such boundaries are at times also referred to as stoppers).

A distribution member generally designated 40 has two deflecting arms 42 and 43 forming together a V-like shape, each arm formed at a bottom surface thereof with a deflecting groove 44 and 45, respectively. The grooves 44 and 45 intersect along an essentially straight line 46 (see FIG. 2) forming a blade-like apex. The distribution member 40 further comprises two laterally projecting pins 48 co-axial with one another and extending about a horizontal axis H, perpendicular to the longitudinal axis L.

The arrangement is such that when the sprinkler is assembled, as seen in FIG. 1, pins 48 are rotatably and slidably received within rectangular openings 32 with side edges 50 and 52 of the deflection grooves 44 and 45 respectively, being engageable with the boundaries stopping members 34 and 36, respectively.

The outcome of this arrangement is that the deflection member 40 is swingable about the axis H and at the same time may be imparted with a sliding motion along a horizontal plane normal to the longitudinal axis L defined by the horizontal orientation of the rectangular openings 32.

Further attention is now directed to FIGS. 3A to 3D for better understanding how the sprinkler of FIG. 1 operates, wherein reference numbers used are the same as those referred to in FIGS. 1 and 2.

Figures 3A, 3B, 3C, 3D:
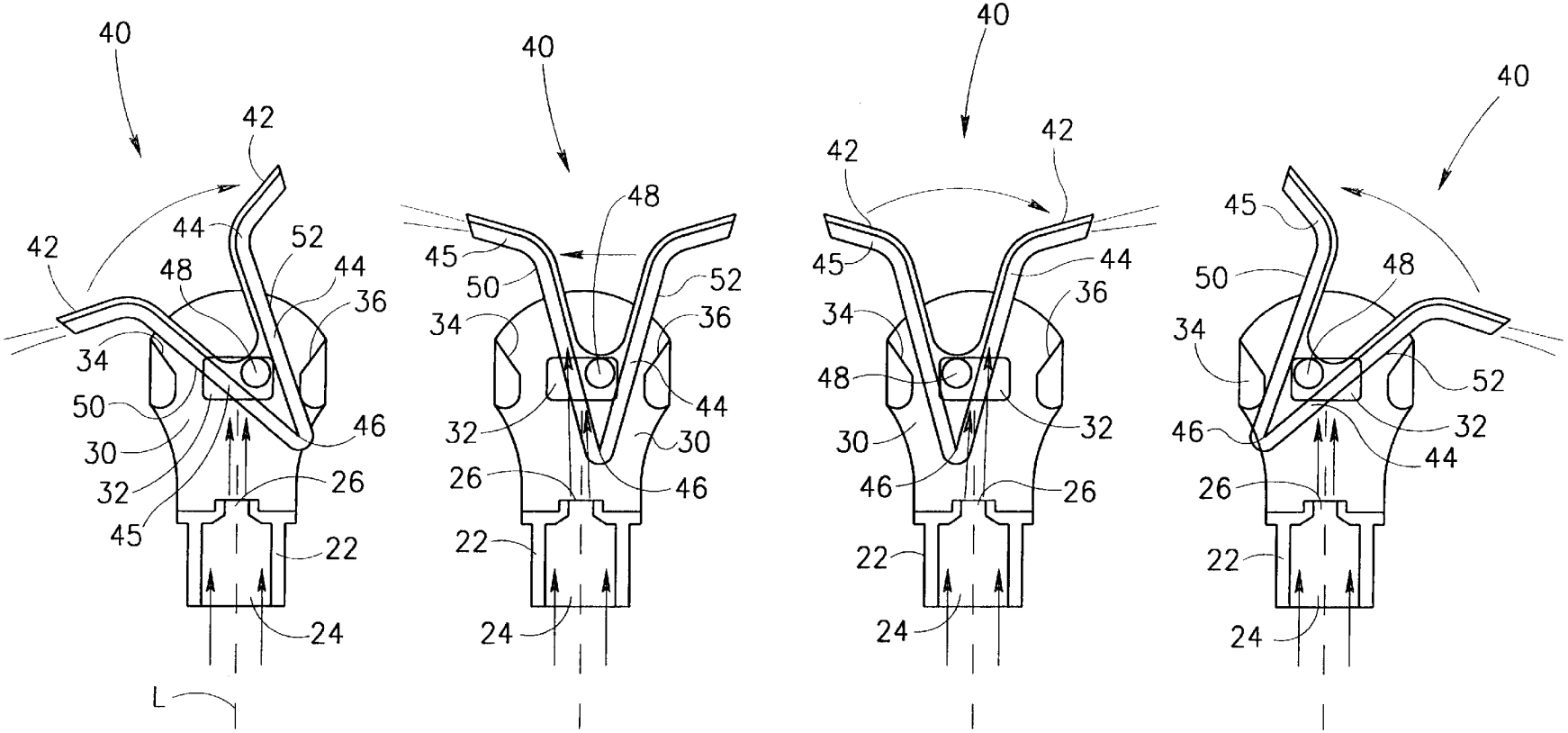
FIGS. 3A to 3D are longitudinal, schematic views of the sprinkler in accordance with a first embodiment of the present invention illustrating four consecutive steps of the irrigation process.

At an initial stage, the deflecting member 40 may be found at any one of the positions 3A to 3D, or at intermediate stages not shown. For the sake of illustration, FIG. 3A was selected as an initial position. Water entering the body 22 via inlet 24 is emitted via outlet nozzle 26 essentially vertically along the longitudinal axis L. The water jet emitted from outlet nozzle 26 strikes deflection groove 45 whereby a reactionary force imparts the deflection member 40 a combined motion consisting of a rocking motion about pin 48 until edge 52 of the deflector comes to rest against boundary stopping member 36, and an auxiliary motion where pin 48 slides within horizontal opening 32 to an extreme right end thereof, as seen in FIG. 3A. In this position, water is emitted only to a left side of the sprinkler and at a nearest range, depending on the angle of deflection of the deflecting arms 42.

Referring now to FIG. 3B, it can be seen that the reactionary force causes the deflection member 40 to rock about axis H (axis H extends through co-axial pins 48), whereby the distribution member 40 is angularly disposed in a clockwise direction to the position seen in FIG. 3B, wherein the water is still emitted only from the left side deflection groove 45 but to a greater range than in the position illustrated in FIG. 3A.

Turning now to FIG. 3C of the drawings, it is seen that pin 48 of the distribution member has moved to the left end of the rectangular opening 32 with the intersecting line 46 moving to the left of the longitudinal axis L, whereby the water jet emitted from the outlet nozzle 26 now strikes against the right side deflection surface 44, resulting in water emitted to a long distance as in FIG. 3B. It will be appreciated that FIG. 3C is actually a mirror image of FIG. 3B.

In FIG. 3D the reactionary forces have caused the deflection member 40 to conclude its clockwise rotation until the edges 50 of groove 45 come to rest against the boundary stoppers 34 with water emitted from deflection groove 44 at an essentially short distance, similar but in an opposite direction to that seen in FIG. 3A. It is at this stage that the reactionary forces cause the deflection member to begin its rotation in a counter-clockwise direction and into the position seen in FIG. 3A.

It will be further appreciated that the positions illustrated in FIGS. 3A to 3D are merely representative consecutive steps of the irrigation process, wherein in reality the deflection member performs a continuous rocking motion about the horizontal axis H and a simultaneous sliding reciprocal horizontal motion defined within the horizontal opening 32, as explained hereinabove.

Further attention is now directed to FIGS. 4 and 5 which are a different application of the first embodiment of the present invention, wherein reference is made to those portions which are principally different than the embodiment defined with reference to FIGS. 1–3. The sprinkler 60 comprises a body 62 with an outlet nozzle 63, a bifurcated support bracket generally designated 64 fitted with two support walls 66, each formed adjacent atop end thereof with a horizontally extending rectangular opening 68. A distribution member 70 has a V-like shape fitted with two deflection arms 72, each having a deflecting groove 74 and 76, respectively, intersecting along an essentially blade-like apex 78 at a lowermost end thereof. The distribution member 70 further comprises two lateral semi-cylindrical projections 80 having a radius being slightly smaller than the width of the rectangular opening 68 for the reason hereinafter to become apparent.

As seen in the Figures, lateral projections 80 have a flat and essentially horizontal bottom surface 82, corresponding with the bottom surface 83 of the rectangular opening 68.

Further attention is directed to FIGS. 6A to 6E, illustrating consecutive steps of an irrigation sequence of the sprinkler, in accordance with the second application of the first embodiment. Reference numerals used in FIGS. 6A to 6D are similar to those used in FIGS. 4 and 5.

Figure 6B:
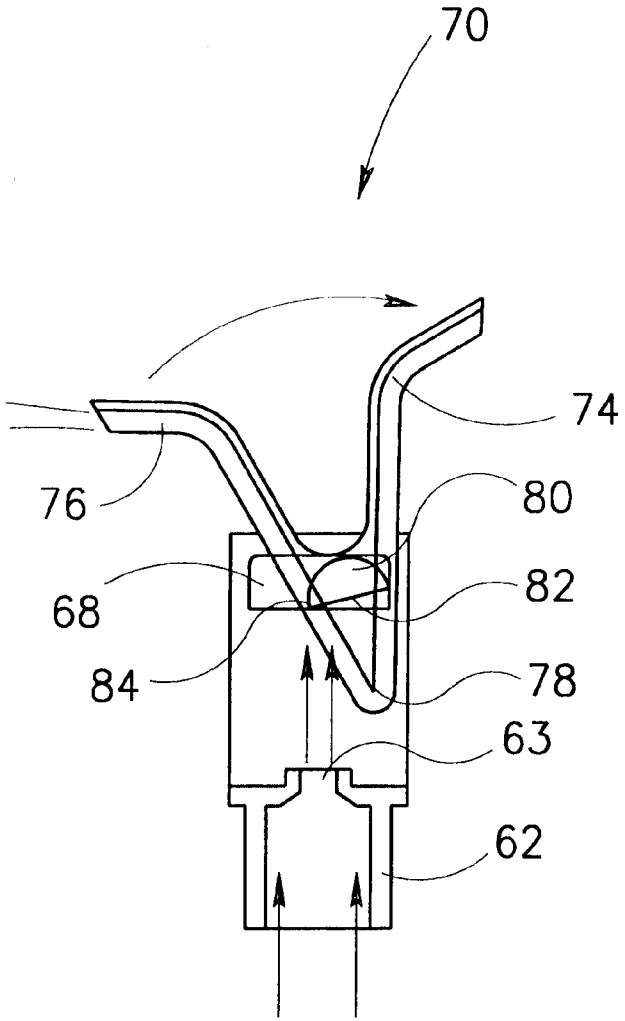
FIGS. 6A to 6E are longitudinal schematic views of the embodiment seen in FIG. 4 illustrating four consecutive steps of an irrigation process.
Figure 6A:
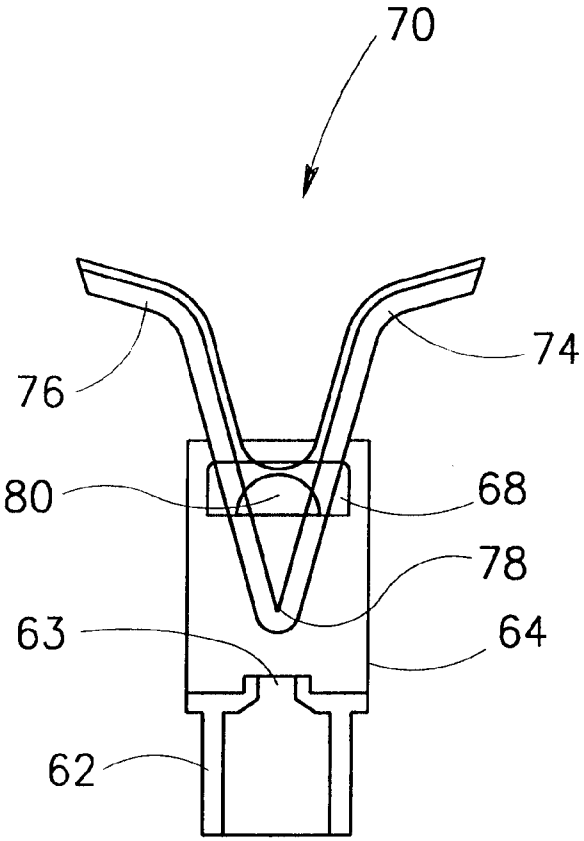

In FIG. 6A the sprinkler is shown at an initial, rest position, wherein surface 82 of the lateral projections 80 of the distribution member 70 is in the rest over the horizontal bottom surface 83 of openings 68 of the support bracket 64.

As seen in FIG. 6B, a water jet emitted from outlet nozzle 63 encounters the deflecting groove 76 causing the latter to tilt in a counter-clockwise direction to an extent in which an end 84 of bottom surface 82 of lateral projections 80 encounters the bottom surface 83 of rectangular opening 68, and a surface of the arced portion of lateral projections 80 encounter a top surface of the rectangular opening 68, whereby the distribution member 70 is restricted from further rotation in the counter-clockwise direction. In this position irrigation water is emitted only to the left side of the sprinkler to a near zone, depending on the deflecting angle of the deflecting groove 76.

Figure 6E:
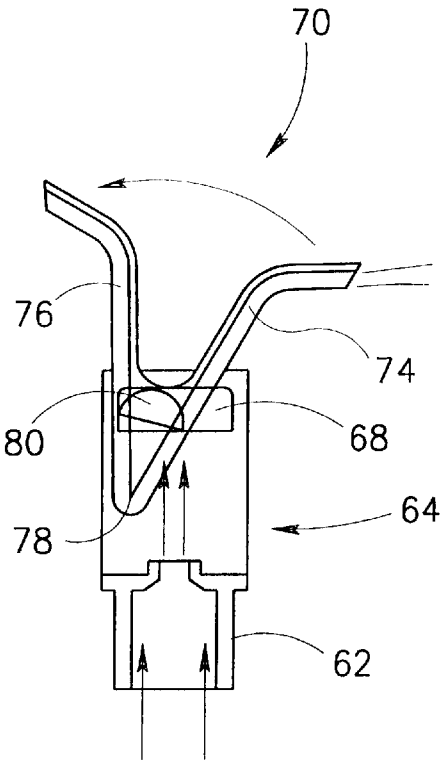
Figure 6D:
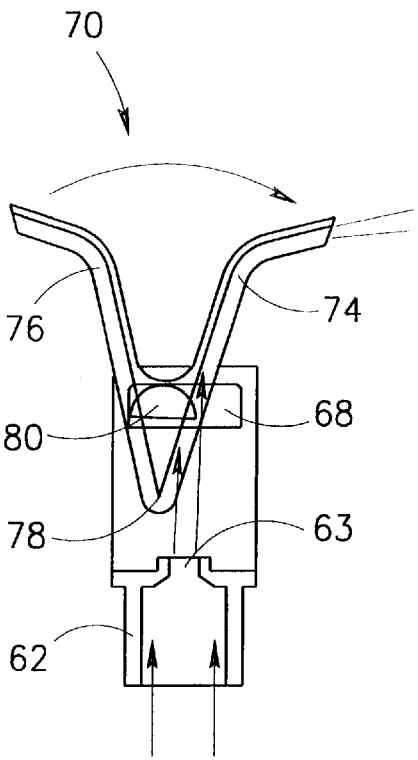
Figure 6C:
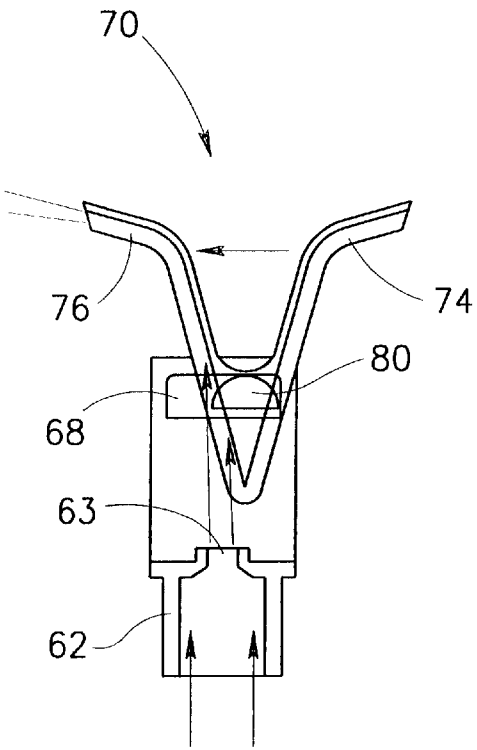

The reactionary forces continue to act on the distribution member 70 until it begins rotation in a clockwise direction to the position seen in FIG. 6C where it is essentially horizontal, and where water emitted from outlet nozzle 63 encounters the left deflecting groove 76, throwing the water to a large distance.

The water jet striking the distribution groove 76 eventually causes it to slightly tilt in a clockwise direction, as seen in FIG. 6D, entailing sliding of deflection member 70 to a left-most position as seen in FIG. 6D, whereby the water jet now strikes over deflection groove 74, emitting water to a long distance. In consequence, the reactionary forces cause the deflection member 70 to keep rotating in a clockwise direction as seen in FIG. 6E up to an extent where the lateral projections 80 prevent further rotation of the distribution member within the horizontal rectangular opening 68 (as explained in connection with FIG. 6B), whereby water is emitted to the right side of the sprinkler at a short distance, as seen in FIG. 6E, which in fact is a mirror image of FIG. 6B.

It will thus be readily understood that the process is continuous whereby the water jet striking against the deflection groove 74 will eventually entail counter-clockwise tilting of the distribution member 70 with consecutive sliding thereof to a right-most position, as seen in FIG. 6B.

Figure 7A:
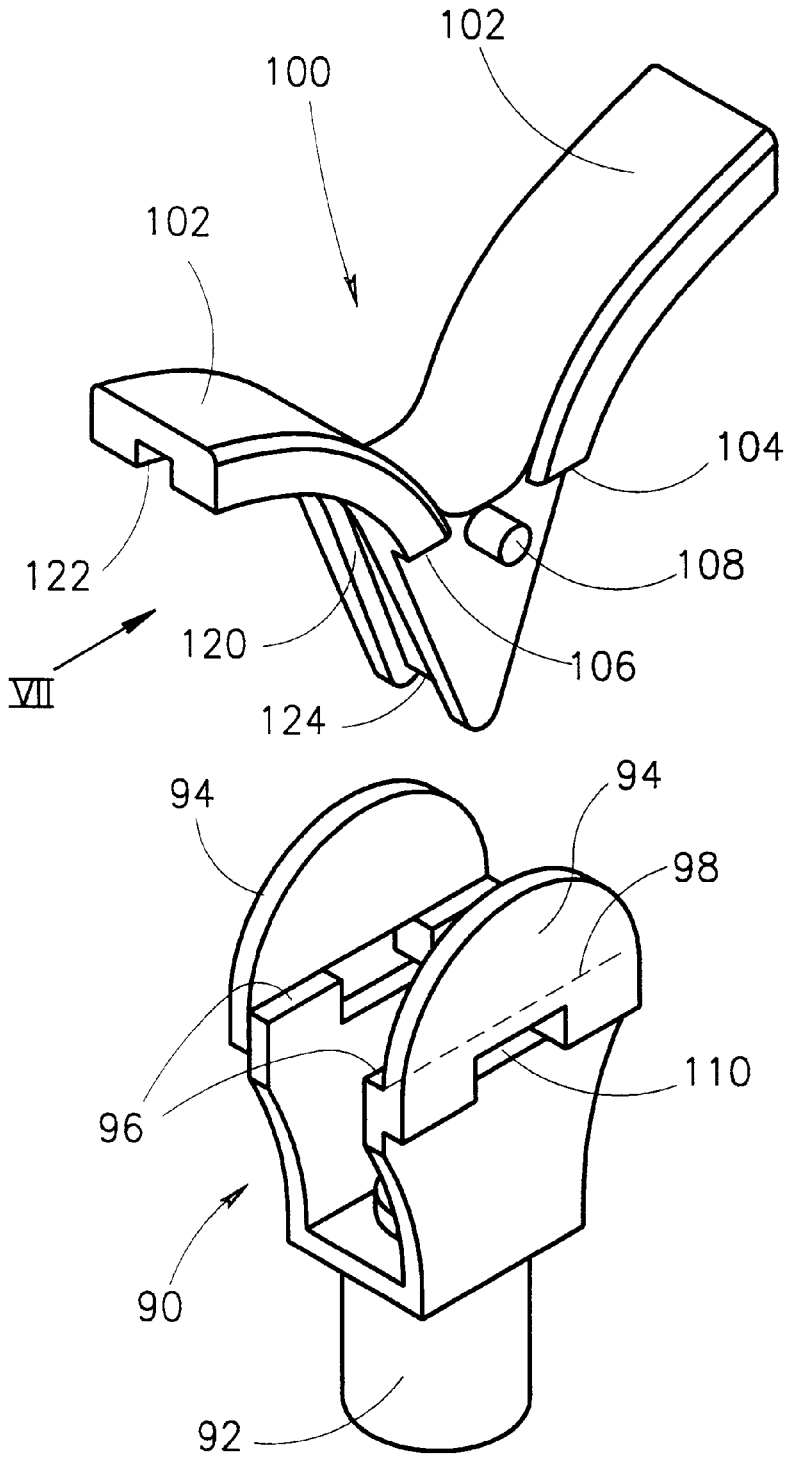
FIG. 7A is an exploded perspective view of still a further application of the first embodiment of a sprinkler in accordance with the present invention.

Further attention is now directed to FIG. 7A, which is another application of the embodiment seen in FIGS. 1 and 2 and wherein reference is made only to those portions which differ from the application of FIGS. 1 and 2. The bifurcated support bracket 90 is mounted over the body member 92, wherein each support wall 94 comprises at each end a flat, horizontal surface 96 and 98. The distribution member 100 comprises deflection arms 102 terminating at an essentially flat boundary surface 104 and 106 adapted for engagement with the surfaces 96 and 98, respectively. It can thus be readily understood that the rocking motion of the distribution member 100 about the horizontal axis extending through pins 108 within the rectangular openings 110 of support bracket 90 is restricted each time one of the boundary surfaces 104 and 106 engages one of the respective surfaces 96 and 98 respectively.

Figure 7B:
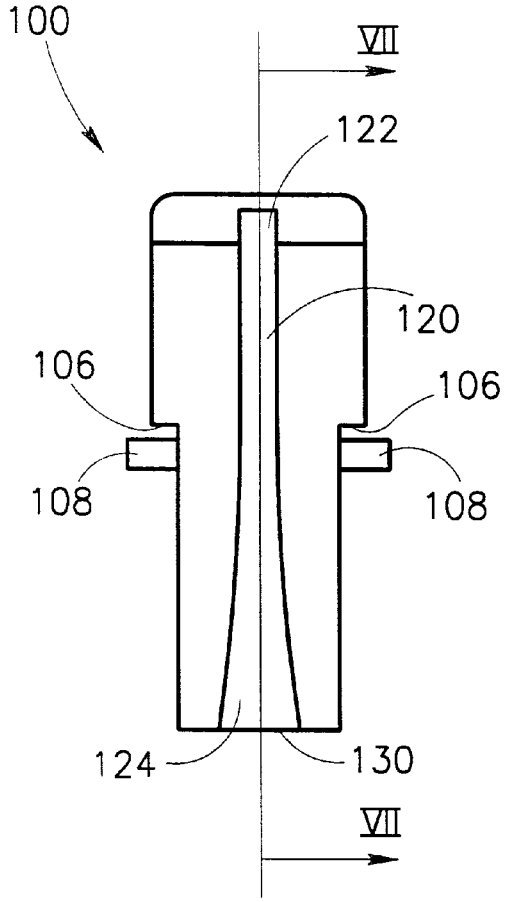
FIG. 7B is an elevation from direction VII in FIG. 7A.

As can be seen also in FIG. 7B, the deflection groove 120 of the distribution member 100 has a discharge end 122 at a top end thereof and a lowermost end 124 wherein the distribution end 122 is essentially narrower than the lowermost end 124.

Figure 7C:
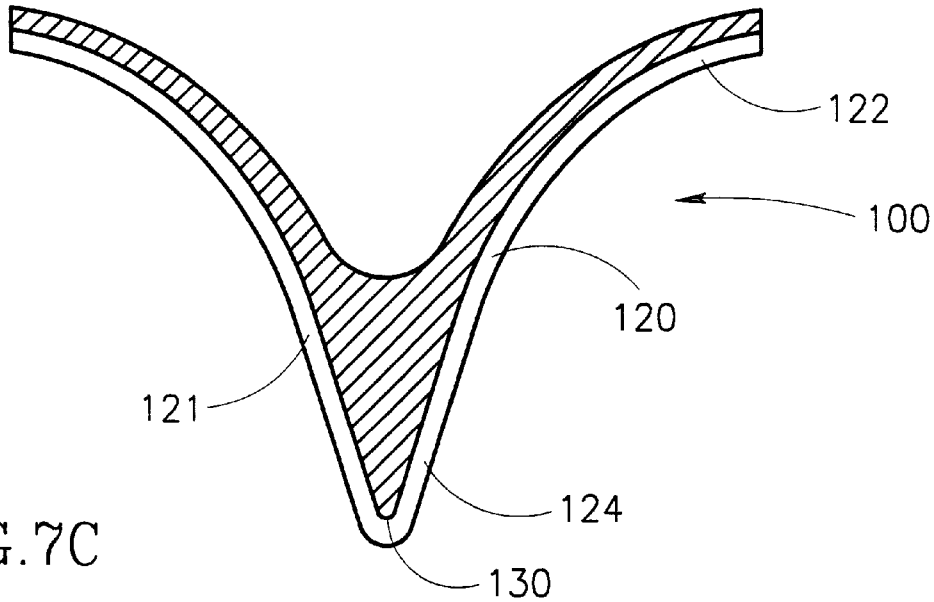
FIG. 7C is a cross section of the distribution member taken along line VII—VII in FIG. 7B.

FIG. 7C is a cross-section along lines VII—VII in FIG. 7B, wherein it can be seen that the deflecting grooves 120 and 121 intersect at a lowermost end via a curved surface 130, rather than at a blade-like apex as in the previous applications. It will be appreciated that the construction discussed with reference to FIGS. 7A to 7C is applicable with any of the embodiments and applications of the present invention.

Figure 8:
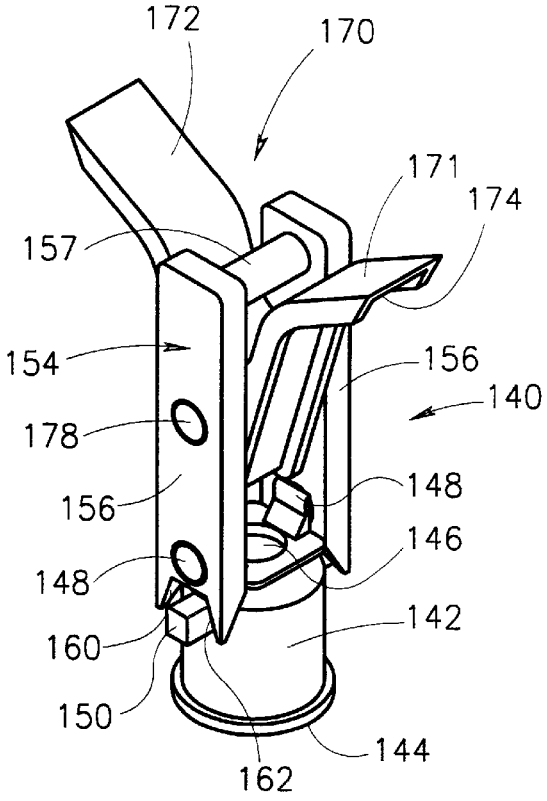
FIG. 8 is a perspective view of a sprinkler in accordance with a second embodiment of the present invention.
Figure 9:
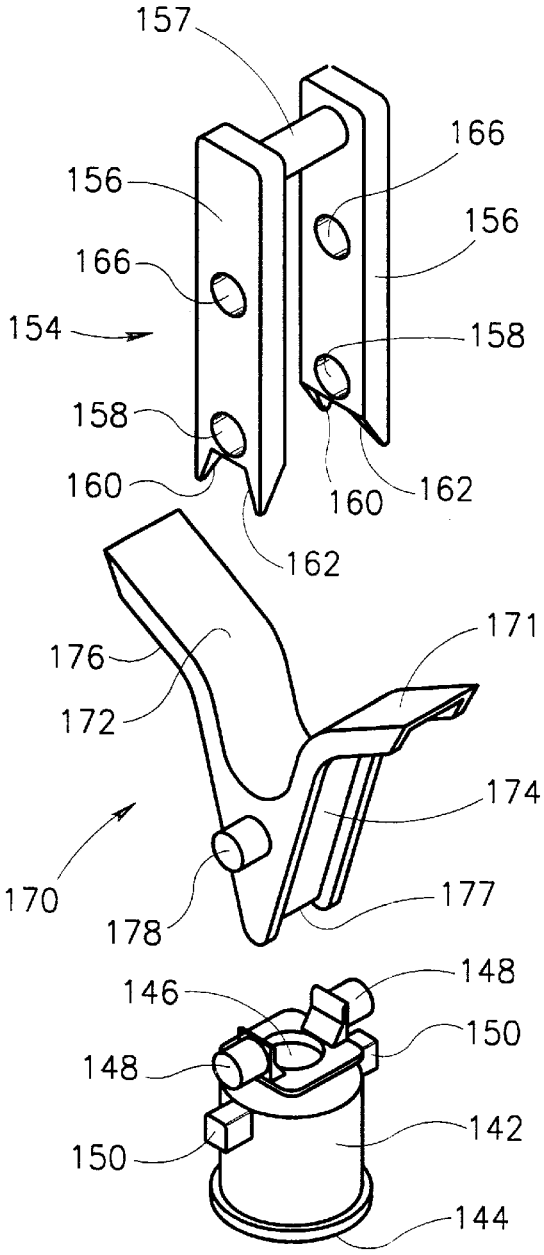
FIG. 9 is a perspective exploded view of the embodiment of FIG. 8.

Further attention is now directed to FIGS. 8 and 9 illustrating a strip sprinkler in accordance with a second embodiment of the present invention. The sprinkler generally designated 140 comprises a body member 142 fitted with a water inlet 144 and an outlet nozzle 146, defining between them a longitudinal axis. The housing is further fitted with a pair of laterally projecting cylindrical pins 148 defining between them an axis perpendicular to said longitudinal axis, and a pair of laterally projecting rectangular stopper members 150 extending along an axis parallel to said horizontal axis of the pins 148.

A bifurcated support bracket 154 comprises two arms 156 rigidly connected to one another by a connecting member 157. Each arm is formed adjacent at lower end thereof with an opening 158 for hingingly mounting over pins 148 of body member 142 and two downwardly projecting boundary members 160 and 162. Each arm 156 further comprises an aperture 166 for swingingly receiving a distribution member 170.

The distribution member 170 is a V-like shaped member, comprising two arms 171 and 172, each formed at a lower surface thereof, with a distribution groove 174 and 176 respectively, intersecting with one another at a lower end thereof 177. The distribution member 170 further comprises two lateral projections 178 (only one seen) adapted for being hingingly received within apertures 166 of support bracket 154.

The arrangement is such that the distribution member 170 is swingable with respect to support bracket 154, with connecting member 157 serving as a boundary limit each time a top surface of one of the arms 171 or 172 encounters same. An auxiliary reciprocal motion is obtained by swinging motion of the support bracket 154 about pins 148 of the housing, where its angular displacement is restricted by the boundary members 160 and 162 encountering in turn the stopper members 150 of the body 142.

FIGS. 10A to 10D illustrate consecutive steps of an irrigation process of the sprinkler disclosed with reference to the embodiment of FIGS. 8 and 9 using the same reference numerals.

Figures 10A, 10B, 10C, 10D:
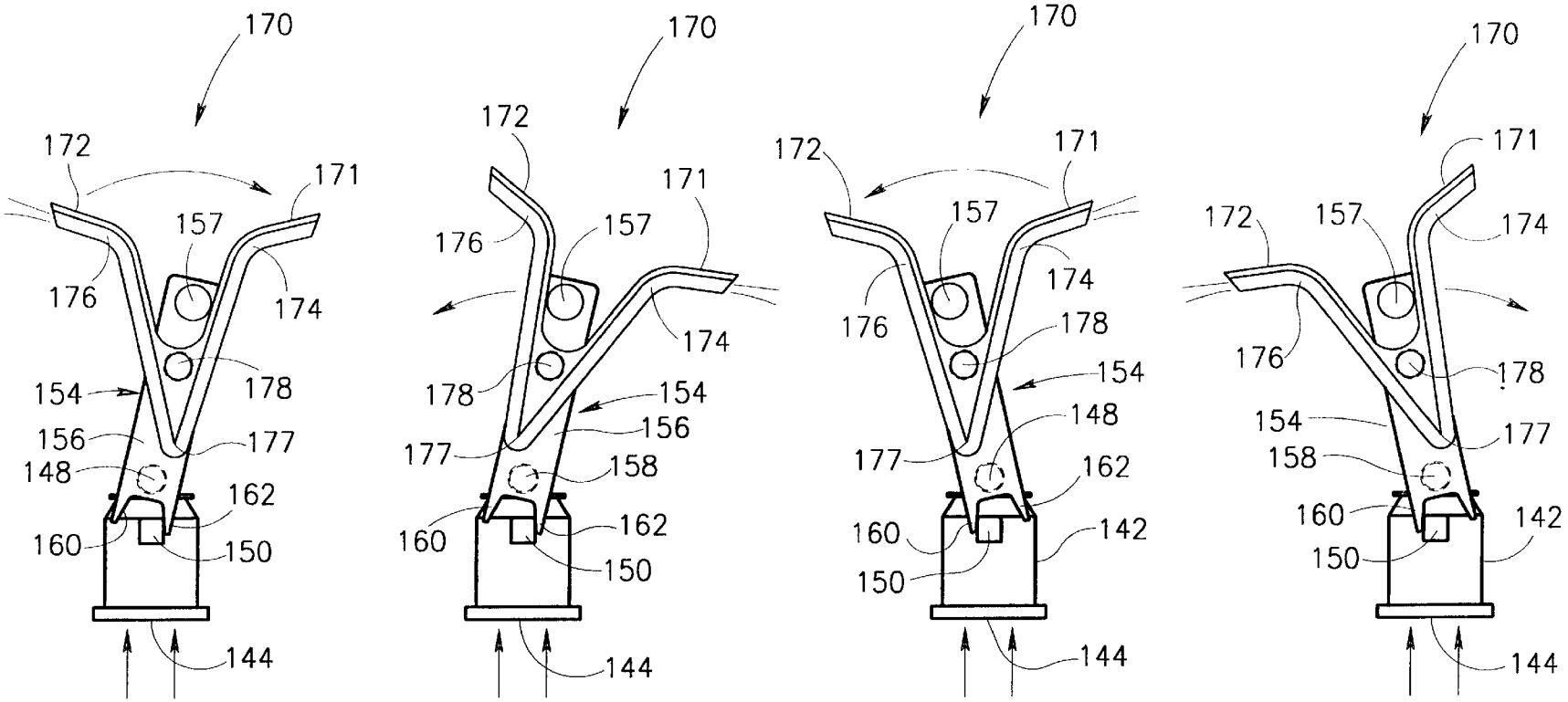
FIGS. 10A to 10D are longitudinal schematic views of the sprinkler of FIG. 8, illustrating four consecutive steps of an irrigation process.

In FIG. 10A it is seen that the support bracket 154 is tilted to the right with boundary members 162 encountering stoppers 150 of the body member 142, with the distribution member 170 being tilted to a left-most position wherein a top surface of the right arm 171 encounters the connecting member 157 of the support bracket 154 and wherein the intersecting point 177 extends to the right of the outlet nozzle 146 (not seen). The arrangement in this position is such that a water jet emitted from the outlet nozzle 146 encounters the distribution groove 176 emitting water to the left side of the sprinkler at an essentially short distance.

Consequently, the water jet generates reactionary forces, whereby the distribution member 170 swings with respect to support bracket 154 in a clockwise manner to the position seen in FIG. 10B, wherein a top surface of the left arm 172 encounters the connecting member 157 with intersecting point 177 now extending to the left of the longitudinal axis of the body 142, whereby the water jet emitted from outlet 146 (not seen) strikes the right deflection groove 174, with the water emitted to the right side of the sprinkler at a short distance.

The continuing reactionary forces applied by the water jet on the distribution member 170 eventually cause the support bracket 154 to tilt in a clockwise direction over pins 148 into a position seen in FIG. 10C, wherein the boundary members 160 encounter the stoppers 150 and wherein the intersection 177 still extends at a left side of the longitudinal axis, wherein the water jet emitted from the outlet nozzle (not seen) is deflected via deflecting groove 174 to the right side of the sprinkler at an essentially long distance.

In FIG. 10D the support bracket 154 is still in its left-most position with the distribution member 170 now tilted in a counter-clockwise direction, wherein the top surface of arm 171 encountering the connecting member 157 and intersection 177 extending at a right side of the longitudinal axis of the body 142, wherein the water jet emitted from the outlet nozzle 146 (not seen) strikes the left deflection groove 176, whereby water is emitted to a left side of the sprinkler at an essentially short range.

As explained hereinabove in connection with the previous embodiments, it should be readily understood to a skilled person that the consecutive steps illustrated in FIGS. 10A to 10D are intermediate positions of a cycle of operation and it should be appreciated that the combined motion of the distribution member and the support bracket is a continuous gradual process, wherein water is emitted from either of the deflecting grooves 174 or 176, covering a full range of irrigation with the distance being depending on the inclination angle of the deflecting arm.

Figure 12:
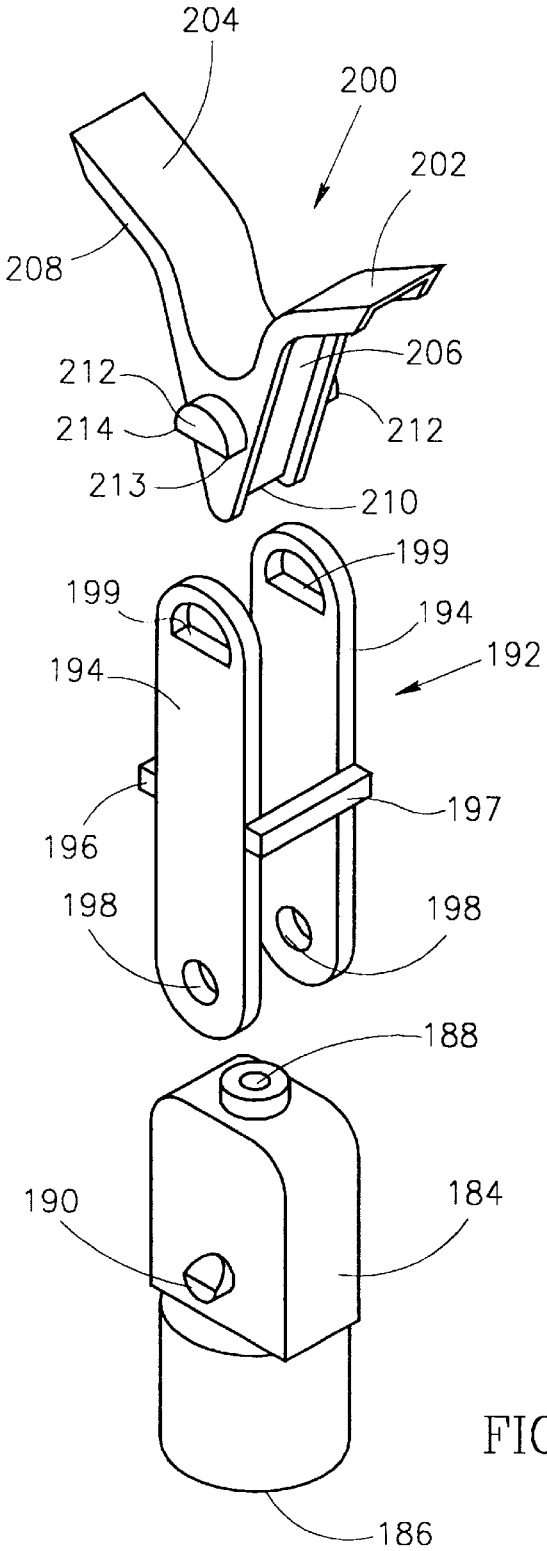
FIG. 12 is an isometric, exploded view of the sprinkler of FIG. 10.
Figure 11:
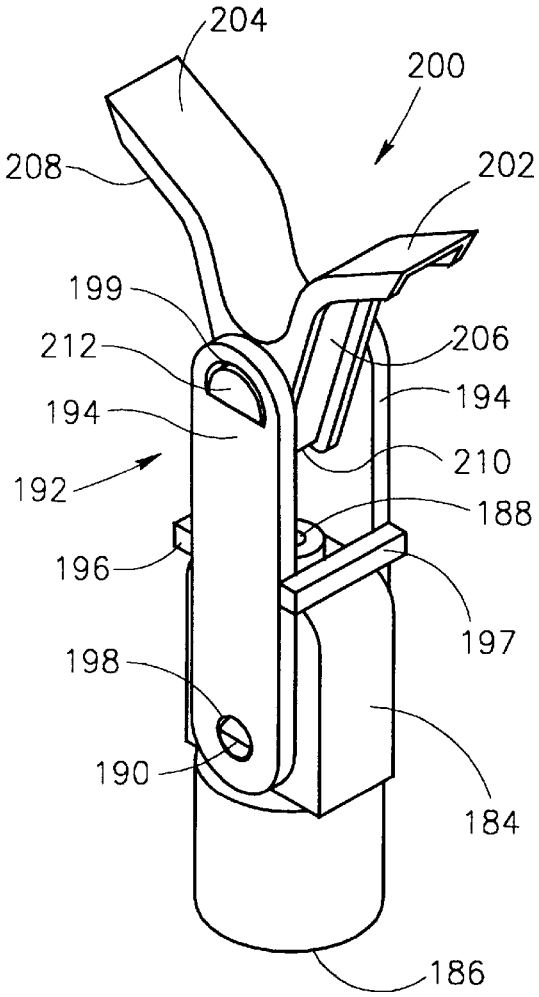
FIG. 11 is an isometric view of a second application of the sprinkler in accordance with the second embodiment of the invention.

FIGS. 11 and 12 illustrate an application of the second embodiment of the present invention, wherein the body 184 has an inlet 186 and an outlet nozzle 188 defining between them a longitudinal axis. The body 184 is further provided with laterally projecting pivot pin 190 (only one seen) for swingingly receiving a support bracket 192 consisting of two support walls 194 connected to one another via a left connecting member 196 and a right connecting member 197. Each of the support walls 194 is formed adjacent at a lower end thereof with an opening 198 pivotally mounted over pins 190 of the body 184, and adjacent an upper end thereof with a semi-circular opening 199.

A distribution member generally designated 200 has two deflection arms 202 and 204 arranged in a V-like shape fitted at bottom surfaces thereof with deflection grooves 206 and 208, respectively, intersecting at 210. The distribution member 200 is fitted with two laterally projecting semi-circular projections 212 loosely fitted within the semi-circular openings 199 of the support bracket 192, wherein the distribution member 200 is swingable with respect to the support bracket 192, the latter capable of rocking with respect to the body 184, as will be explained with reference to FIGS. 13A to 13D, in which the same reference numerals are used.

It should be noted that the radii of the semi-cylindrical lateral projections 212 is smaller than that of the openings 199 of support bracket 192, although they correspond with one another. This arrangement ensures that the distribution member 200 is free to rock with respect to the support bracket 192, with bottom edges 213 and 214 of the projections 212 serving as boundaries each time they encounter the bottom surface of the openings 199, as can readily be understood.

FIGS. 13A to 13D illustrate consecutive steps of a sequence of irrigation of the sprinkler seen in FIGS. 11 and 12. As mentioned in connection with the previous embodiments, the positions illustrated in FIGS. 13A to 13D represent consecutive steps of a continuous, gradual process and the various positions are selected for explaining the sequence of operation.

Figures 13A, 13B, 13C, 13D:
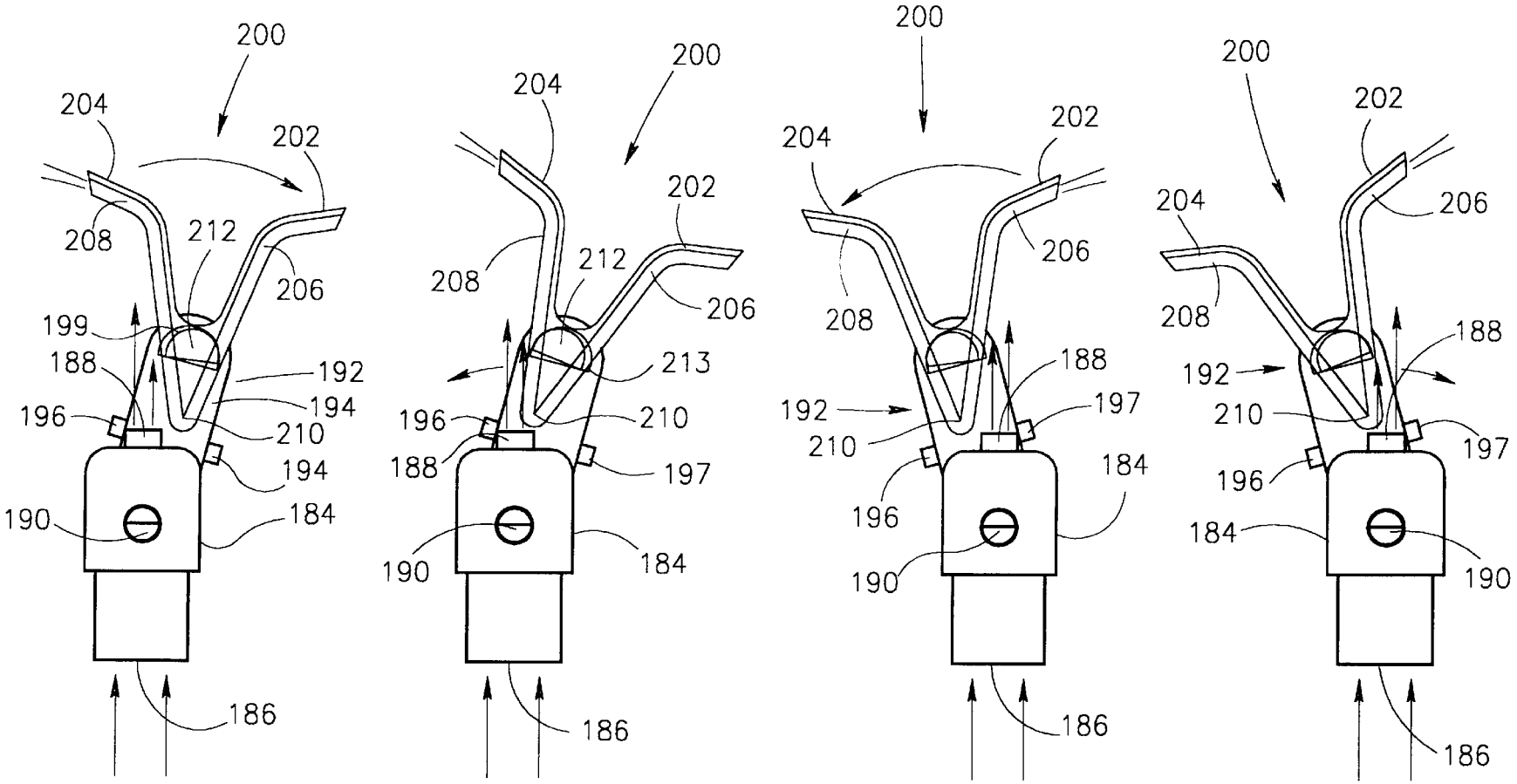
FIGS. 13A to 13D are longitudinal schematic view of the sprinkler of FIG. 10, illustrating four consecutive steps of an irrigation process.

In FIG. 13A the support bracket 192 is tilted in a clockwise direction with the right connecting member 196 bearing against the outlet nozzle 188 and the distribution member 200 being tilted counter-clockwise with respect to the support bracket 192, wherein a water jet emitted from outlet nozzle 188 strikes the deflection groove 208 emitting water to the left side of the sprinkler at an essentially short distance.

The water jet emitted from the outlet nozzle 188 generates reactionary forces causing the distribution member 200 to gradually tilt in a clockwise manner to the position seen in FIG. 13B, wherein its angular displacement is restricted by the edge 213 of lateral projection 212 encountering the bottom surface of openings 199. In this position the water jet encounters the left deflection groove 208, emitting water to a left side of the sprinkler at an essentially long distance.

The reactionary forces generated by the water jet striking the distribution member eventually cause the intersection 210 to communicate with the water jet, as a result of which the support bracket 192 tilts in a counter clockwise direction to the position seen in FIG. 13C with the connecting member 197 encountering the outlet nozzle 188 and preventing its further tilt to the left. In this position the intersection 210 has moved to a left side of the longitudinal axis, with water jet emitted from outlet nozzle 188 now striking the deflection groove 206, emitting water to the right side of the sprinkler at an essentially short distance.

In FIG. 13D the support bracket 192 remains in its position of FIG. 13C with the distribution member 200 tilted counter-clockwise (as in FIG. 13A) with the water jet now emitted from the right deflection groove 206 at an essentially large distance.

Figure 14B:
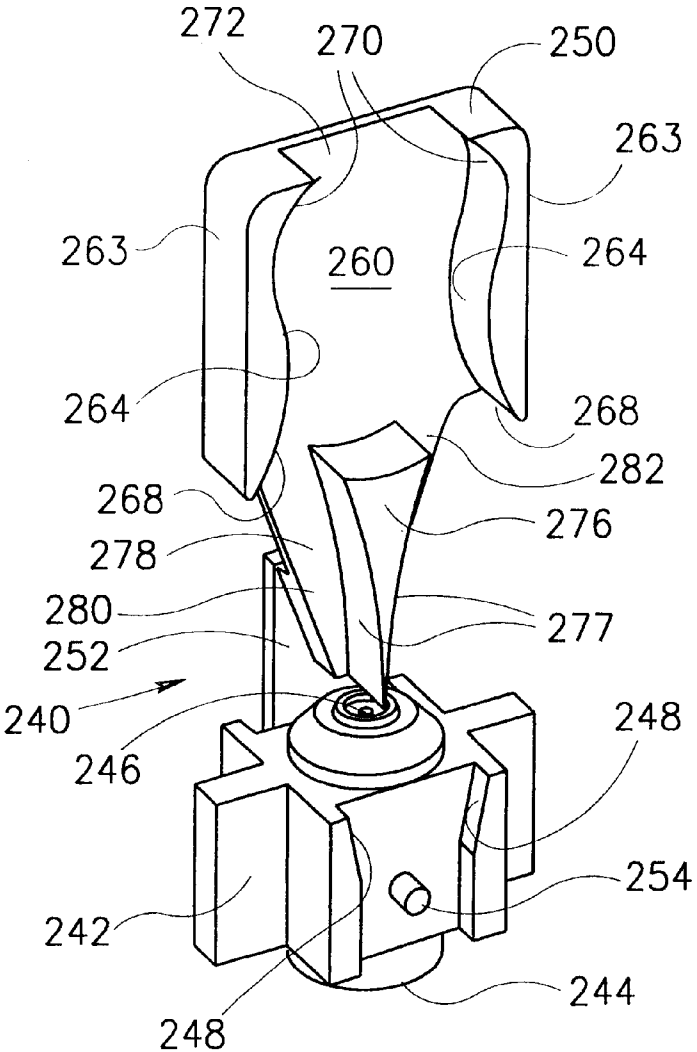
Figure 14A:
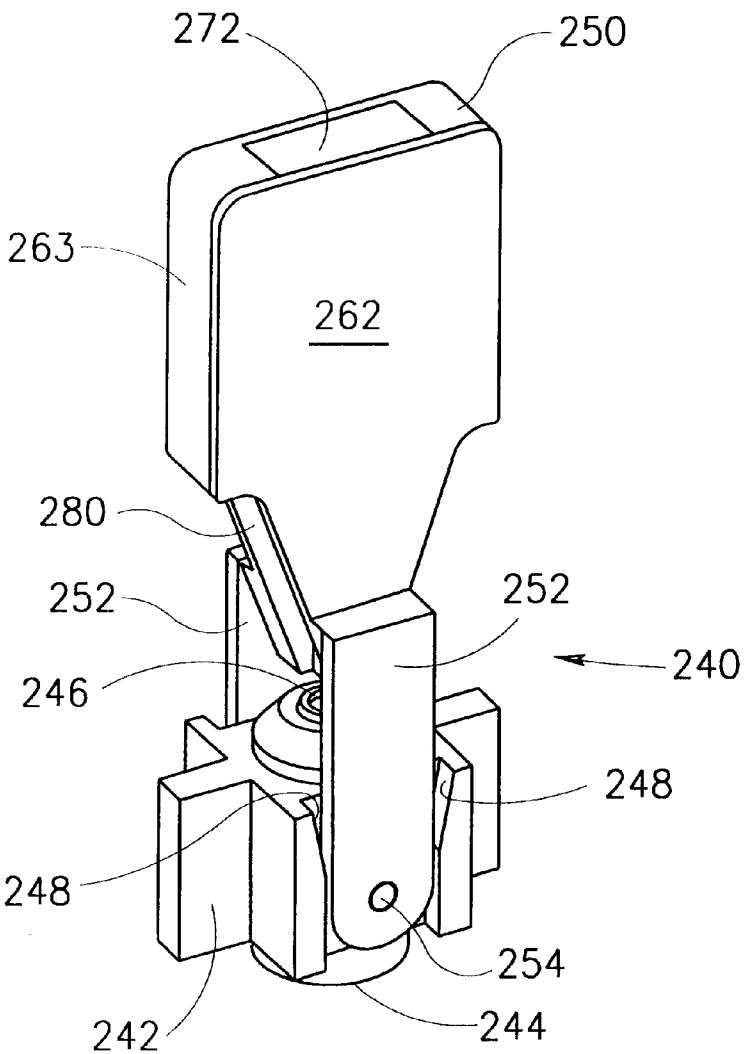

Further attention is now directed to FIGS. 14A and 14B, which illustrate a modification of an irrigator according to the present invention. The irrigator, generally designated 240, comprises a body member 242 fitted with an inlet 244 and an outlet 246, between which a longitudinal axis of the irrigator is defined, extending essentially vertically.

The body member 242 comprises two inclined wall members 248 which serve as boundary elements, as will become apparent hereinafter.

Distribution member 250 is integrally fitted with two brackets 252 (only one seen in FIG. 14B), pivotally connected to pins 254 laterally projecting from body 242. Pins 254 (only one seen) define a horizontal axis being normal to the longitudinal axis.

In the embodiment of FIGS. 14A and 14B, distribution member 250 is fitted with one fixed side wall 260 and one removable side wall 262, which in FIG. 14B is removed for the sake of exposing other components of the irrigator. Brackets 252 form an integral part with the respective walls 260 and 262 although, other arrangements are possible wherein the brackets are detachably connected to the side walls, as an artisan will appreciate.

Lateral walls 263 of distribution member 250 are formed at their inner surface 264 with an undulating shape which has a wide, diverging inlet portion 268 and a narrower, converging portion 270, where the two converging portions constitute together an outlet 272 of the distribution member 250.

At a lower end of the distribution member 250 there is a deflecting member 276 which is integrally formed with the side wall 260 and which has side walls 277 defining an essentially V-like shape and which together with the wall portion 278 of the side walls define two ducts 280 and 282 (best seen in FIGS. 15) which ducts define deflection grooves.

It is noted in FIG. 14B that the lowermost, intersection of walls 277 of the deflection member 276 is positioned essentially above outlet 246, when the distribution member 250 is in a vertical position.

Figure 15C:
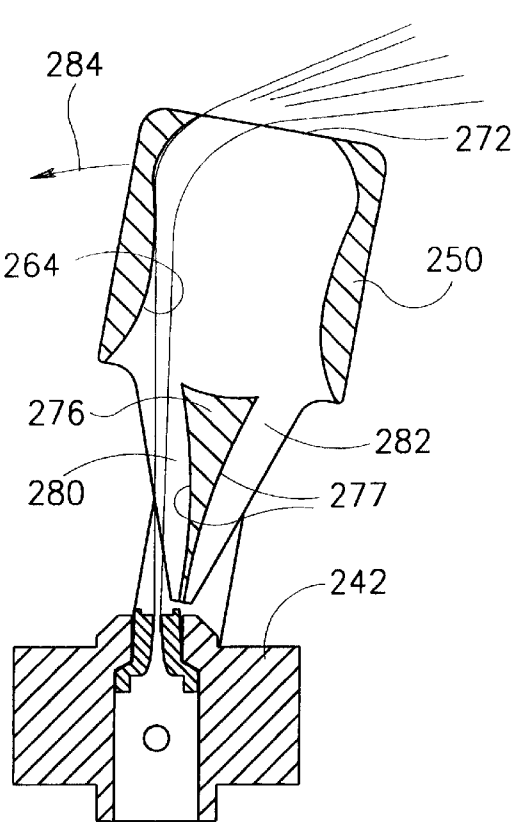
FIGS. 15A–15C are longitudinal cross-sectional views of the sprinkler of FIGS. 14, illustrating three consecutive steps of an irrigation process.
Figure 15B:
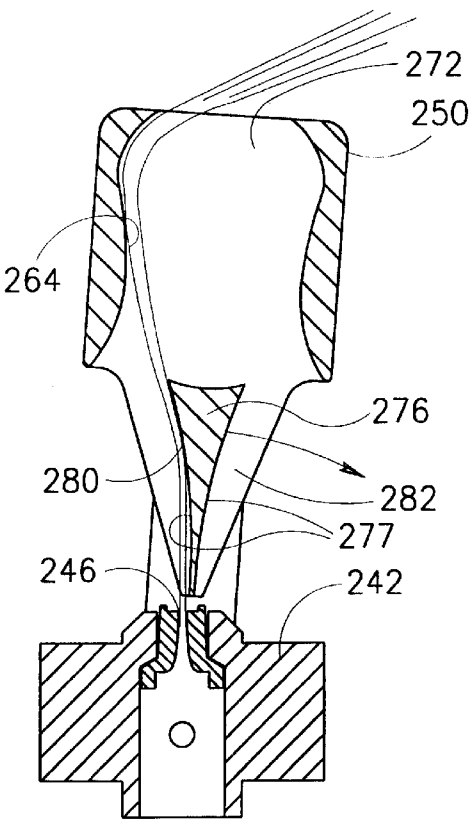
Figure 15A:
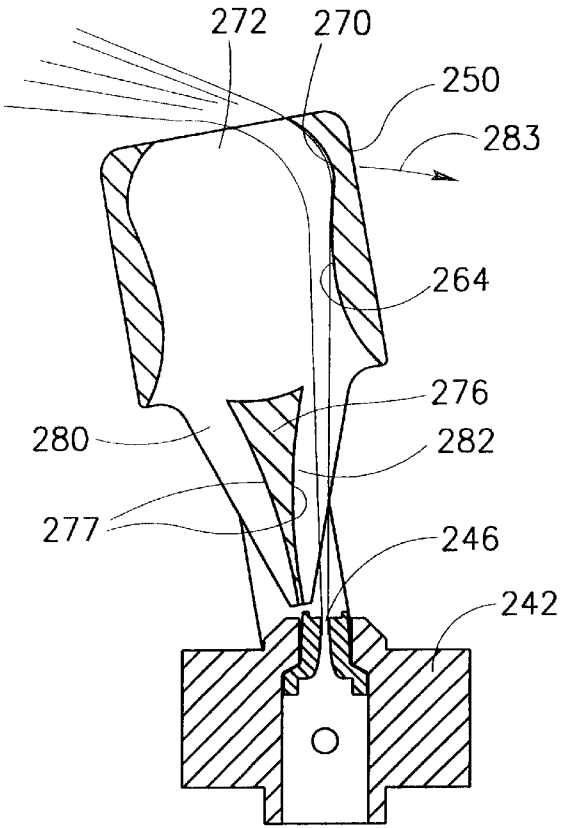

Turning now to FIGS. 15A–15C, a sequence of an irrigation process is illustrated. In FIG. 15A, the distribution member 250 is tilted in a counter-clockwise direction. A water jet emitted from outlet nozzle 246 of body member 242 is directed essentially vertical and enters the right side duct 282. Thereafter, the water jet engages with the undulating deflection surface 264 and upon engagement with the converging portion 270 it is deflected to the left side, whereupon it exits through outlet 272. However, as the water engages with the portion 270 it generates a reactionary force (represented by arrow 283) causing the distribution member 250 to gradually tilt in a clockwise manner.

As the side edges of brackets 252 encounter either of boundary elements 248 the tilting motion of the distribution member is restricted, where it begins its trip in a counter-direction.

In a mid-position seen in FIG. 15B, the distribution member 250 is already partially tilted in a clockwise direction wherein water is emitted to the right side of the sprinkler and the water jet emitted from outlet 246 strikes the left wall 277 of the member 276 and generates a reactionary force causing the distribution member 250 to further rotate in a clockwise direction into the position seen in FIG. 15C, wherein water engages the left side undulating surface 264, then exiting via opening 272 towards the right hand of the irrigator.

The position seen in FIG. 15C is similar but inverted to the position of FIG. 15A, wherein water is emitted to the right side of the irrigator whereas a reactionary force is generated in an opposite direction represented by arrow 284, causing the distribution member 250 to begin a tilting motion in a counter-clockwise direction, into the position seen in FIG. 15A.

Figure 16C:
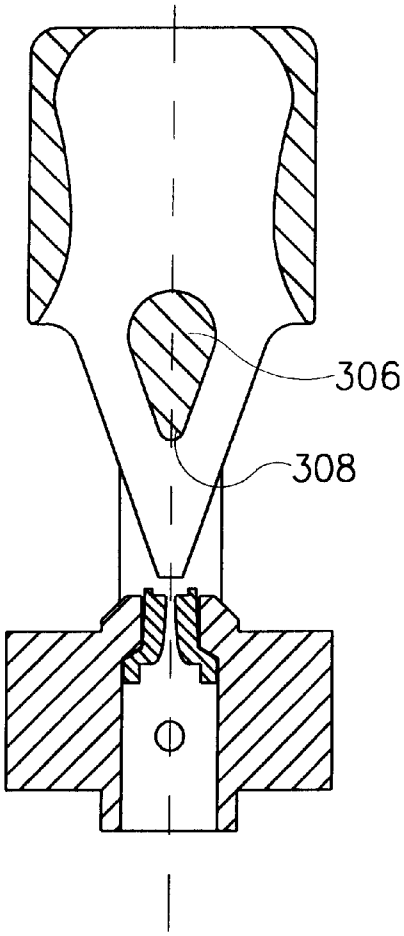
FIGS. 16A–16C are longitudinal cross-sections of the sprinkler in accordance with the embodiment of FIG. 14, illustrating different designs of duct forming members of the distribution member.
Figure 16B:
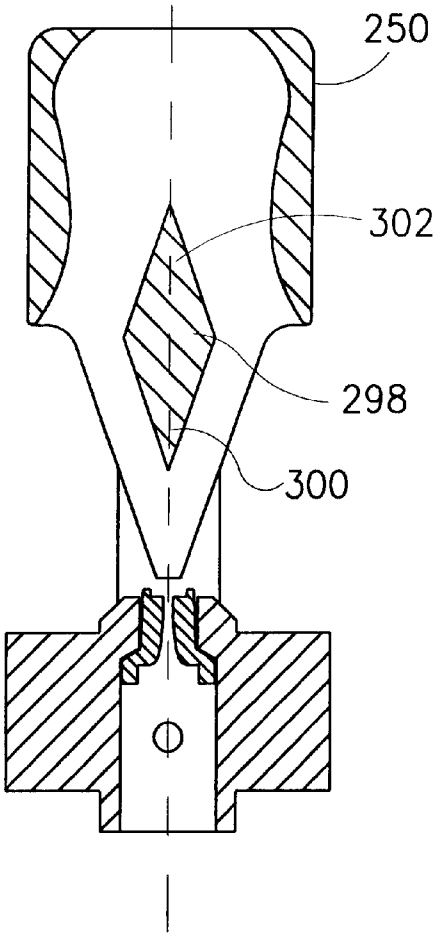
Figure 16A:
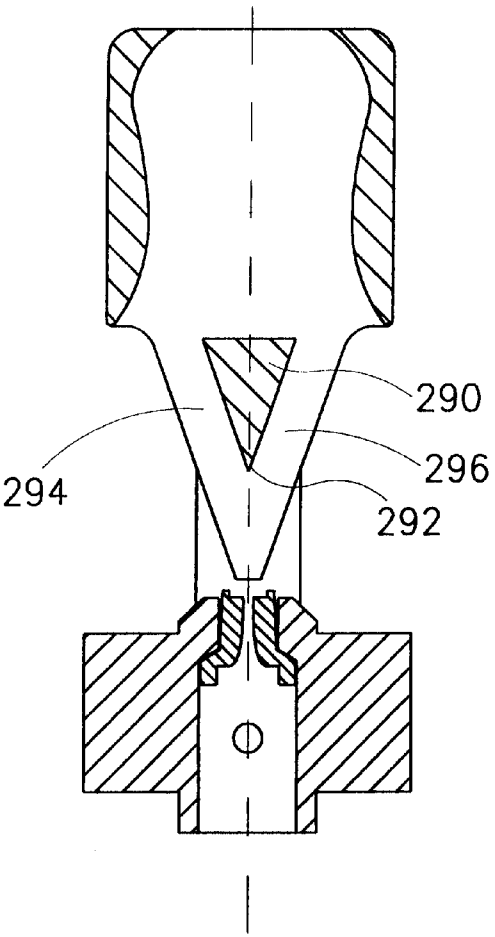

Deflection member 276 may be designed in many different ways defining essentially V-like shaped walls and ducts. In FIGS. 16A–16C different designs of deflection members are seen. In FIG. 16A, deflection member 290 has the shape of a triangle with its vertex 292 constituting the point of intersection of duct members 294 and 296. In FIG. 16B, deflection member 298 has the shape of a rhombus with its bottom part 300 being essentially similar to deflection member 290 of FIG. 16A and a top portion 302 extending into the upper portion of the distribution member 250 and which serves as a water interruption, influencing the reactionary forces involved in the tilting process. In FIG. 16C, the deflection member 306 has a drop-like shape with its apex being rounded at 308.

A skilled person will appreciate that many other shapes and designs of deflection members are possible, each having a different influence on the flow pattern of the water emitted from the irrigator as well as different tilting behavior caused by different reactionary forces influenced by the different patterns of the deflection member.

It should be understood that the teaching of the present invention is applicable, mutatis mutandis, in other applications, such as, for example, by designing different boundary members and different deflecting grooves, etc.

What is claimed is:

1. A strip irrigator comprising:

a body member fitted with an inlet for coupling to an irrigation water supply and an outlet nozzle of said body member, defining a longitudinal axis;

a distribution member formed with a water engaging portion consisting of two ducts forming between them an essentially V-like shape with an intersection adjacent a lower end thereof, each duct ending at a deflection groove;

a support bracket pivotally supporting the distribution member to said body member;

wherein responsive to a water jet emitted from said outlet nozzle, the distribution member generates reactionary forces imparting it with a reciprocal rocking motion about a horizontal axis that is perpendicular to the longitudinal axis, and further wherein said horizontal axis is located below said intersection of said ducts of said distribution member.

2. The strip irrigator according to claim 1, wherein the deflection grooves extend from the intersection, and where at least a first portion of said deflection grooves face away from one another.

3. The strip irrigator according to claim 2, wherein said reactionary forces impart the distribution member with a combined motion consisting of the reciprocal rocking motion and an auxiliary reciprocal motion consisting of a second motion being a swinging motion about a second horizontal axis perpendicular to said longitudinal axis.

4. The strip irrigator according to claim 3, wherein said support bracket is reciprocally swingable with respect to the body member about said horizontal axis.

5. The strip irrigator according to claim 2, wherein the deflection grooves intersect along an essentially straight line forming a blade-like apex.

6. The strip irrigator according to claim 2, wherein water is emitted from the strip irrigator in a direction opposite to that of the duct which engages the water.

7. The strip irrigator according to claim 1, wherein the support bracket is integral with the distribution member.

8. The strip irrigator according to claim 1, formed with boundary elements for restricting the rocking motion.

9. The strip irrigator according to claim 8, wherein the support bracket is formed with the boundary elements.

10. The strip irrigator according to claim 8, wherein the body member is fitted with the boundary elements.

11. The strip irrigator according to claim 1, wherein an irrigation pattern emitted from the irrigator is essentially a rectangle extending at each side of the irrigator and being about 4–5 m long and about 0.5 m wide.

12. The strip irrigator according to claim 1, wherein essentially all the irrigation water emits from either one of the deflection grooves of the distribution member.

13. The strip irrigator according to claim 1, wherein an upper, discharge end of each of the deflection grooves of the distribution member is narrower than the ducts.

14. The strip irrigator according to claim 1, further comprising a swingable connection for connecting said distribution member with said support bracket, wherein said swingable connection is located along a secondary horizontal axis that is located above said intersection of said ducts of said distribution member.

15. The strip irrigator according to claim 14, wherein said swingable connection includes a set of lateral projections configured to be mated with a corresponding set of apertures.

16. The strip irrigator according to claim 14, wherein said swingable connection includes a set of semi-circular projections that are loosely fitted within a corresponding set of semi-circular openings.

17. The strip irrigator according to claim 1, wherein said ducts of said distribution member are open on at least one side thereof.

18. The strip irrigator according to claim 1, wherein an irrigation pattern formed by said strip irrigator is essentially rectangular.

* * * * *